US006755040B2

(12) United States Patent
Kim et al.

(10) Patent No.: US 6,755,040 B2
(45) Date of Patent: Jun. 29, 2004

(54) AIR CONDITIONER AND CONTROL METHOD THEREOF

(75) Inventors: Jong-Moon Kim, Suwon (KR); Jai-Kwon Lee, Suwon (KR); Jae-Hyo Jeong, Suwon (KR); Seung-Chul Kim, Seoul (KR); Youn-Cheol Park, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/237,128

(22) Filed: Sep. 9, 2002

(65) Prior Publication Data

US 2003/0205052 A1 Nov. 6, 2003

(30) Foreign Application Priority Data

May 1, 2002 (KR) ..... 2002-0023991

(51) Int. Cl.[7] ..... E25B 19/00; E25B 1/00; F04B 49/06

(52) U.S. Cl. ..... 62/228.1; 62/231; 417/44.1; 417/1

(58) Field of Search ..... 62/228.1, 228.4, 62/228.5, 231, 158; 417/43, 44.1, 53, 1

(56) References Cited

U.S. PATENT DOCUMENTS 4,622,827 A * 11/1986 Jabami et al. ..... 62/158
4,909,043 A * 3/1990 Masauji et al. ..... 62/158
6,092,993 A 7/2000 Young et al.

FOREIGN PATENT DOCUMENTS

JP 62280536 A * 12/1987 ..... F24F/11/02
JP 04217762 A * 8/1992 ..... F25B/45/00

* cited by examiner

*Primary Examiner*—Chen Wen Jiang
(74) *Attorney, Agent, or Firm*—Staas & Halsey LLP

(57) ABSTRACT

An air conditioner and a method of controlling the air conditioner includes a variable capacity compressor being operated at a maximum capacity in a case of starting an operation of the compressor after an extended stoppage for a lengthy period of time longer than a preset reference time, thus increasing a flow rate of a circulated refrigerant during an initial stage of the operation and increasing a quantity of heat generated from the motor of the compressor to vaporize and forcibly discharge a remaining liquid refrigerant from the compressor during the initial stage. Therefore, the variable capacity compressor of the air conditioner does not require heaters conventionally used for heating the refrigerant during such a stoppage, and so easy designing and production of the compressor is achieved, in addition to a reduction in a production cost of the air conditioner. This air conditioner also accomplishes a reduction in a maintenance cost thereof.

24 Claims, 5 Drawing Sheets

AIR CONDITIONER AND CONTROL METHOD THEREOF

CROSS-REFERENCE TO RELATED APPLICATIONS

This application claims the benefit of Korean Patent Application No. 2002-23991, filed May 1, 2002, in the Korean Industrial Property Office, the disclosure of which is incorporated herein by reference.

BACKGROUND OF THE INVENTION

1. Field of the Invention

The present invention relates, in general, to an air conditioner and, more particularly, to an air conditioner with a variable capacity compressor and a method of controlling such an air conditioner.

2. Description of the Related Art

As well known to those skilled in the art, an air conditioner controls an indoor temperature by transferring heat between a refrigerant and one of indoor air and outdoor air. The air conditioner typically includes an indoor heat exchanger, an outdoor heat exchanger, a compressor, etc. During a cooling mode operation of the air conditioner, the heat is transferred from the indoor air to the refrigerant in the indoor heat exchanger and is dissipated from the refrigerant to the outdoor air in the outdoor heat exchanger so as to cool the indoor air. During a heating mode operation of the air conditioner, the refrigerant absorbs the heat generated in the outdoor heat exchanger and dissipates the heat to the indoor air at the indoor heat exchanger, thus heating the indoor air.

FIG. 1A is a block diagram showing a construction of an air conditioner having a conventional outdoor unit. As shown in FIG. 1A, the refrigerant flowing from an indoor unit 114 during a cooling mode operation of the air conditioner is introduced into a compressor 104 through a four-way valve 106. The compressor 104 compresses the input refrigerant to make high pressure and high temperature refrigerant, and discharges the refrigerant. The discharged refrigerant from the compressor 104 passes through the four-way valve 106 and flows into an outdoor heat exchanger 110. Thereafter, the refrigerant returns from the outdoor heat exchanger 110 to the indoor unit 114, and the above-mentioned cycle of the refrigerant repeats during the cooling mode operation.

The compressor 104 also contains lubricating oil therein. Therefore, during an operation of the compressor 104, a small quantity of lubricating oil is discharged from the compressor 104 together with the discharged refrigerant. In such a case, the lubricating oil discharged from the compressor 104 circulates through a refrigerant circulating line (refrigerant pipe) of the air conditioner and may reduce a heat exchanging efficiency of the outdoor and indoor units 102 and 114. Particularly, an excessive amount of the lubricating oil may be discharged from the compressor 104 during the operation to severely degrade an operational reliability of the air conditioner. Therefore, an oil separator 108, used for separating the lubricating oil from the refrigerant, is provided on the refrigerant circulating line at a position between the compressor 104 and the four-way valve 106. In such a case, a pressure of the oil separator 106 connected to an outlet port of the compressor 104 is higher than that of an inlet port of the compressor 104, and so the lubricating oil separated from the refrigerant in the oil separator 106 can be returned to the compressor 104.

In a case of a multiunit-type air conditioner with a plurality of indoor units, several compressors may be provided in the outdoor unit to meet an entire load imposed on the multiunit-type air conditioner by the indoor units. Alternatively, the multiunit-type air conditioner may be provided with a compressor having a large capacity suitable for effectively driving the entire indoor units. However, during an operation of the multiunit-type air conditioner, it is occasionally desired to operate only a part of the several indoor units. The entire load imposed on the compressor of the multiunit-type air conditioner thus varies in accordance with the number of the indoor units to be operated. Therefore, it is possible to install a variable capacity compressor in the multiunit-type air conditioner and operate the multiunit-type air conditioner while controlling a variable capacity of the variable capacity compressor in accordance with a variable load determined by the number of the indoor units to be operated.

Examples of the conventional variable capacity compressors in an air conditioner are a rotary type compressor and a reciprocating type compressor. A capacity control of the rotary type compressor is accomplished by controlling a motor speed by using an inverter. In the reciprocating type compressor with two pistons connected to a single crankshaft, a crankshaft is rotated in a forward direction or a reverse direction such that the crankshaft drives one piston set in one cylinder or two pistons set in two cylinders, thus controlling the variable capacity of the variable capacity compressor.

FIG. 1B is a view schematically showing a construction of the conventional variable capacity compressor of the reciprocating type typically used in the air conditioner. As shown in FIG. 1B, a first set of a cylinder 156*a* and a piston 158*a* forms a first compression stage of the compressor while a second set of a cylinder 156*b* and a piston 158*b* forms a second compression stage. The two pistons 158*a* and 158*b* are connected to a single crankshaft 152 and communicate with the four-way valve 106. The crankshaft 152 rotates by a motor 154, and a rotating motion of the motored crankshaft 152 is converted to a rectilinear reciprocating motion of the two pistons 158*a* and 158*b*. Of course, it should be understood that such rectilinear reciprocating motion of the two pistons 158*a* and 158*b* converted from the rotating motion may be accomplished by the use of an appropriate eccentric rotary body in place of the crankshaft 152. Due to such rectilinear reciprocating motion of the two pistons 158A and 158B, refrigerant received in the two cylinders 156*a* and 156*b* is compressed to become high pressure and high temperature refrigerant prior to being discharged from the compressor 104 to the indoor unit 114.

However, when the compressor 104 stops an operation for a lengthy period of time, liquid refrigerant remaining in the refrigerant circulating line gradually moves from the refrigerant circulating line to the compressor 104 so as to coexist with the lubricating oil in the compressor 104. In such a case, a temperature of the stopped compressor 104 is lower than that of the operating compressor 104, thus resulting in an oil separation of the lubricating oil from the refrigerant in the compressor 104, in which the refrigerant moves downward to a lower portion of the compressor 104 while the lubricating oil moves upward to an upper portion of the compressor 104. In a case of starting the operation of the compressor after the oil separation has occurred, liquid refrigerant in place of the lubricating oil may be fed to the parts of the compressor 104 during an initial stage of the operation of the compressor 104. This means that a desired amount of lubricating oil cannot be fed to the parts of the compressor and that a smooth lubricating effect of the parts may not be accomplished.

In an effort to overcome such a problem caused by the oil separation from the refrigerant, two heaters 160*a* and 160*b* may be installed at lower ends of the two cylinders 156*a* and 156*b*, respectively. The two heaters 160*a* and 160*b* heat the liquid refrigerant in the compressor 104 during the stoppage of the operation of the compressor, thus vaporizing the refrigerant, discharging the vaporized refrigerant to an outside of the compressor 104, and allowing only the lubricating oil to remain in the compressor 104.

However, the use of such heaters 160*a* and 160*b* in the compressor 104 undesirably increases a production cost and a maintenance cost of the compressor 104. Furthermore, the heaters 160*a* and 160*b* may be broken and badly affect the compressor 104. However, since the conventional compressor does not have any means for protecting the compressor from such a bad effect exerted by the broken heaters, an operational reliability of the compressor is degraded.

SUMMARY OF THE INVENTION

Accordingly, the present invention has been made keeping in mind the above and other problems occurring in the prior art, and an object of the present invention is to provide an air conditioner with a variable capacity compressor and a method of controlling such an air conditioner, in which the compressor is operated at a maximum capacity thereof in the case of starting the compressor after an extended stoppage of an operation of the compressor for a lengthy period of time longer than a preset reference time, thus increasing both a quantity of heat generated from a motor and an amount of circulated refrigerant, and so the compressor quickly discharges liquid refrigerant remaining therein to an outside of the compressor.

Additional objects and advantageous of the invention will be set forth in part in the description which follows and, in part, will be obvious from the description, or may be learned by practice of the invention.

In order to accomplish the above and other objects, the present invention provides an air conditioner including a variable capacity compressor, a stop time detecting unit, and a control unit. The stop time detecting unit detects a stop time of the compressor. When the detected stop time of the compressor is longer than a preset reference time, the control unit pre-drives the variable capacity compressor at a maximum capacity for a predetermined period of time prior to operating the compressor at a required capacity to meet a load imposed on the compressor.

The present invention also provides a method of controlling such an air conditioner. The method includes pre-driving the compressor for a predetermined period of time in response to the stop time and an outdoor temperature of the compressor and normal-driving the compressor in response to a user selection.

BRIEF DESCRIPTION OF THE DRAWINGS

These and other objects and advantageous of the invention will become apparent and more readily appreciated from the following description of the preferred embodiments, taken in conjunction with the accompanying drawings of which.

DETAILED DESCRIPTION OF THE PREFERRED EMBODIMENTS

Figure 1A:
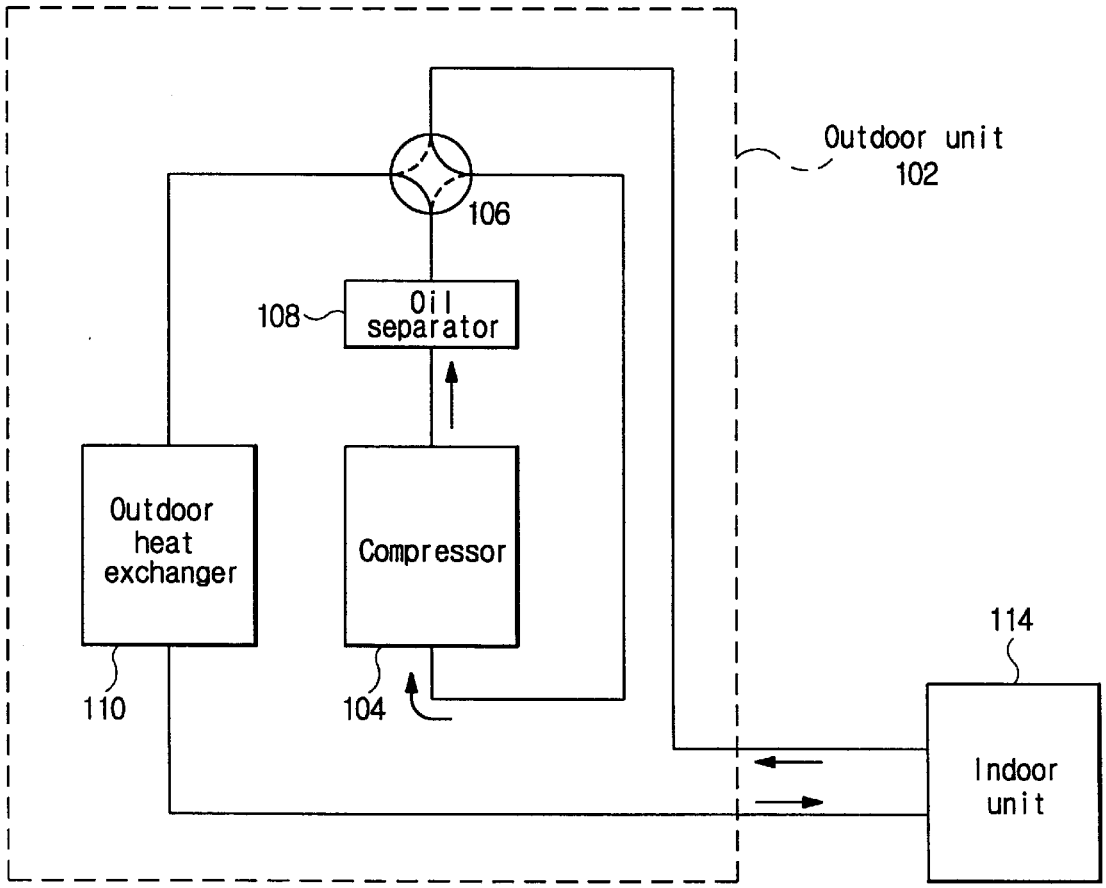
FIG. 1A (PRIOR ART)
FIG. 1A is a block diagram showing a construction of a conventional air conditioner.
Figure 1B:
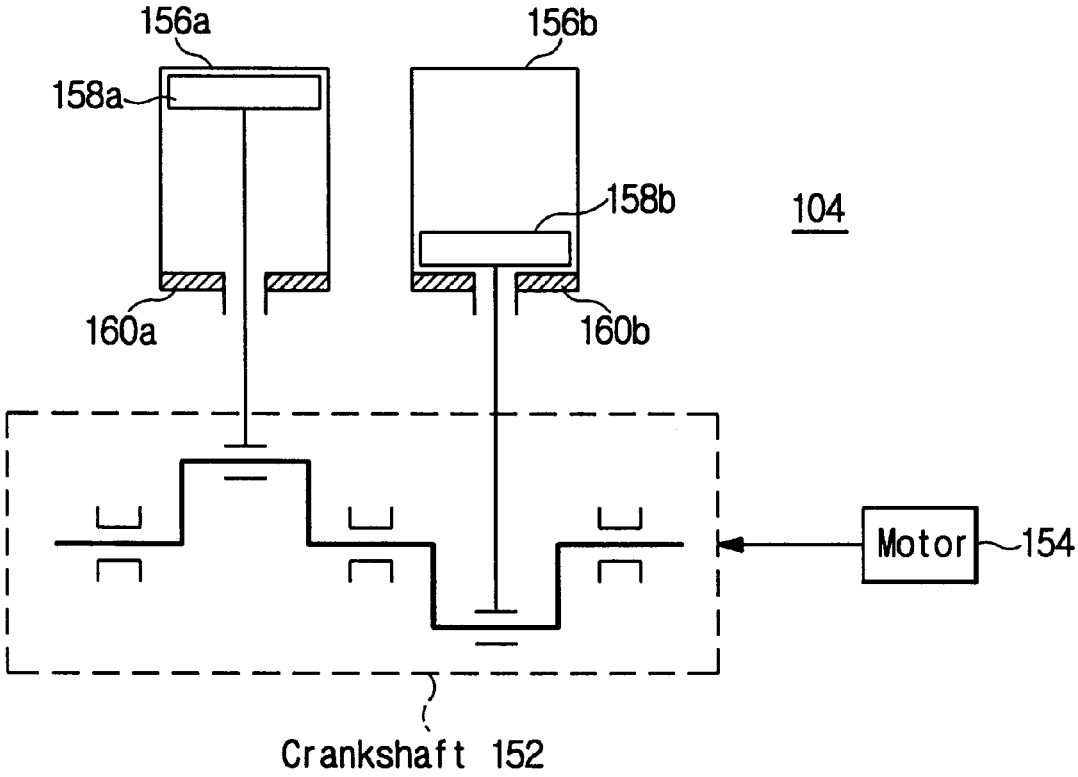
FIG. 1B (PRIOR ART)
FIG. 1B is a view schematically showing the construction of a conventional variable capacity compressor used in the air conditioner of FIG. 1A.

Reference will now be made in detail to the present preferred embodiments of the present invention, examples of which are illustrated in the accompanying drawings, wherein like reference numerals refer to the like elements throughout. The embodiments are described in order to explain the present invention by referring to the figures.

Figure 2A:
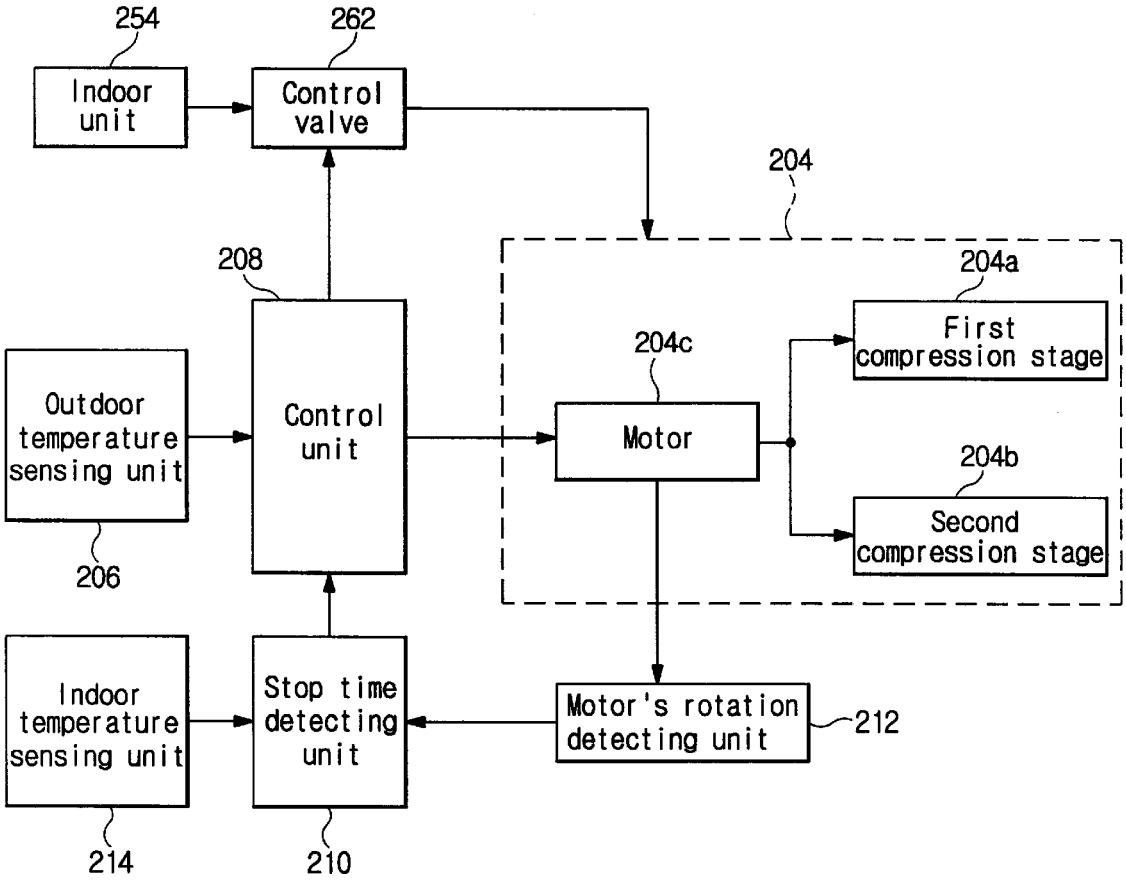
FIG. 2A is a block diagram showing a control system of an air conditioner with a variable capacity compressor in accordance with an embodiment of the present invention.

An air conditioner with a variable capacity compressor 204 and a control method thereof according to an embodiment of the present invention will be described hereinbelow with reference to FIGS. 2A, 2B and 3. FIG. 2A is a block diagram showing a control concept (system) of the air conditioner. As shown in FIG. 2A, when the air conditioner with the variable capacity compressor 204 starts an operation after having been stopped for a period of time, a control unit 208 of the air conditioner controls the compressor 204 by controlling a motor 204C to operate in response to an input signal outputted from a motor rotation detecting unit 212 through a stop time detecting unit 210. The input signal indicates a stop time "ts" of the compressor 204.

The stop time detecting unit 210 detects the stop time "ts" of the compressor 204 and outputs the input signal indicating the stop time "ts" to the control unit 208. In such a case, the stop time detecting unit 210 detects the stop time "ts" of the compressor 204 by counting a time period from a stoppage start time when the compressor 204 stops its operation to a stoppage end time when the compressor 204 starts its operation again after the stoppage. That is, the stop time detecting unit 210 counts the time period from the stoppage start time to the stoppage end time.

A memory of the control unit 208 or a separate data storage unit I stores data representing a reference time "tr" and data representing a pre-driving time of the compressor 204, which are used as reference data in determining a length of the stop time "ts" of the compressor 204. The reference time "tr" means a reference time period during which a large quantity of liquid refrigerant flows through a refrigerant circulating pipe and returns into the compressor 204 after the compressor 204 stops the operation. That is, when the stop time "ts" of the compressor 204 is not longer than the reference time "tr," it is possible to accomplish a normal lubricating effect of parts in the compressor when the operation of the compressor 204 starts after the stoppage. However, when the stop time "ts" of the compressor 204 is longer than the reference time "tr," it is almost impossible to accomplish the normal lubricating effect of the parts of the compressor 204 when the operation of the compressor 204 starts after the stoppage.

In the present invention, the pre-driving time of the compressor 204 must be longer than the reference time "tr" (reference time period) which is required by the lubricating oil to completely return to the compressor 204 when the operation of the compressor 204 starts after the stoppage, and when the remaining liquid refrigerant along with the lubricating oil is entirely discharged from the compressor 204 to the refrigerant circulating line after the operation of the compressor 204 starts. The pre-driving time of the compressor 204 is determined as follows. When the air conditioner is designed by a manufacturer, various time periods required to discharge the remaining liquid refrigerant after starting the operation of the compressor 204 are measured during variously changing the length of the stop time "ts", and the measured time periods are preset to pre-driving times. The data representing the pre-driving times are stored in the memory of the control unit 208 or the separate data storage unit to form a lookup table, and the lookup table is used by the control unit 208 when selecting an appropriate pre-driving time corresponding to a variable stop time "ts" from the pre-driving times of the lookup table during a practical (actual) operation of the air conditioner. The pre-driving time of the compressor 204 is in proportion to the stop time "ts" of the compressor 204, but is in inverse proportion to an outdoor temperature detected by an outdoor temperature sensing unit 206. That is, the pre-driving time of the compressor 204 is increased by an increase of the stop time "ts," and by a decrease of the outdoor temperature.

When the stop time "ts" of the compressor 204 is not longer than the reference time "tr," it is possible to directly drive the compressor 204 at a desired capacity to meet a load imposed by indoor units 254 without pre-driving the compressor 204. In this case, the stop time "ts" of the compressor 204 is short, and an amount of the remaining liquid refrigerant in the compressor 204 is determined as not excessive.

However, when the stop time "ts" of the compressor 204 is longer than the reference time "tr," it is necessary to pre-drive the compressor 204 so as to simultaneously drive first and second compression stages 204*a* and 204*b* of the compressor 204 for a predetermined period of time. When it is determined that all the remaining liquid refrigerant is discharged from the compressor 204 due to the pre-driving, the compressor 204 starts a normal operation at the desired capacity to meet the load imposed by the indoor units 254. In this case, the stop time "ts" of the compressor 204 is long, and the amount of the remaining liquid refrigerant in the compressor 204 is determined as excessive. Since an oil separation from the remaining liquid refrigerant has prominently occurred in the compressor 204, it is almost impossible to expect the normal lubricating effect of the parts of the compressor 204 during an initial stage of operating the compressor 204. Therefore, the first and second compression stages 204*a* and 204*b* of the compressor must be operated at the same time for the predetermined period of time to discharge the remaining liquid refrigerant from the compressor 204.

The first compression stage 204*a* corresponds to a first cylinder and a first piston while the second compression stage 204*b* corresponds to a second cylinder and a second piston. The first and second pistons are connected to a crankshaft of the motor 204*c* of the compressor 204. One of the first and second pistons may selectively rotate by the crankshaft of the motor 204*c*.

Such a simultaneous operation of the first and second compression stages 204*a* and 204*b* means that the compressor 204 operates at a maximum capacity. In such a case, the remaining liquid refrigerant in the compressor 204 is vaporized at a maximum speed (rate), and so the refrigerant is discharged from the compressor 204 at a high speed. When it is determined that all the remaining liquid refrigerant is discharged from the compressor 204, the control unit 208 drives only one of the first and second compression stages and stops the other one of the first and second compression stages, thus normally operating the compressor 204 at a desired capacity to meet the load imposed by indoor units 254. In such a case, since the remaining liquid refrigerant is almost completely discharged from the first and second compression stages 204A and 204B, it is possible to expect the desired normal lubricating of the parts of the compressor 204 using the lubricating oil remaining in the compressor 204.

A preset indoor temperature is a target temperature selected by a user. The user directly presets the target temperature through a user interface of the air conditioner. In the present invention, a comparison of the sensed indoor temperature with the target temperature is performed under the following conditions. That is, temperature allowances (temperature ranges) are preset to determine highest and lowest limits of the target temperature. When a sensed indoor temperature sensed by an indoor temperature sensing unit 214 is within one of the temperature ranges defined between the highest and lowest limits of the target temperature, the control unit 208 determines that the sensed indoor temperature is equal to the target temperature, and does not operate the compressor 204 of the air conditioner. However, when the sensed indoor temperature is out of the temperature range, the control unit 208 determines that the sensed indoor temperature is not within the temperature range of the target temperature. The control unit 208 thus operates the compressor 204 of the air conditioner.

The user interface, the indoor temperature sensing unit 214, and the control unit 208 may form a signal receiving unit receiving a capacity value of the compressor 204 corresponding to a load imposed on the compressor 204 by receiving the target temperature selected by the user and by detecting the indoor temperature to be compared with the target temperature. In response to a signal from the signal receiving unit, the control unit performs a normal driving of the compressor 204 according to the required capacity value selected by the user and a capacity corresponding to the number of the indoor units 254 after pre-driving the compressor in response to the stop time "ts" or the outdoor temperature.

Figure 2B:
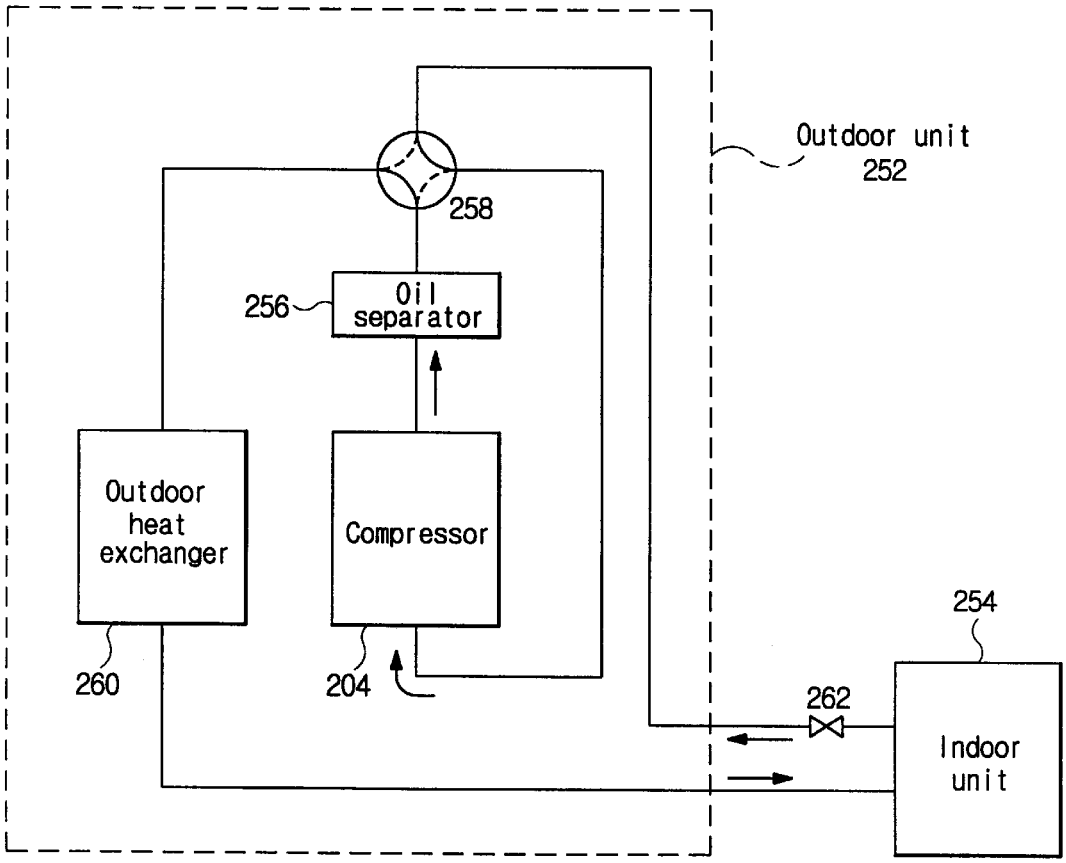
FIG. 2B is a block diagram showing a construction of the air conditioner of FIG. 2A.

FIG. 2B is a block diagram showing a construction of the air conditioner having the control system of FIG. 2A. As shown in FIG. 2B, the refrigerant flowing from the indoor unit 254 during a cooling mode operation of the air conditioner is introduced into the compressor 204 through a four-way valve 258. The compressor 204 compresses the input refrigerant to generate high pressure and high temperature refrigerant and discharges the high pressure and high temperature refrigerant. The output refrigerant discharged from the compressor 204 passes through the four-way valve 258 and flows into an outdoor heat exchanger 260. Thereafter, the refrigerant returns from the outdoor heat exchanger 260 to the indoor unit 254, and the above-mentioned cycle is repeated during the cooling mode operation.

When the compressor 204 stops the operation for a lengthy period of time, or when the outdoor temperature is low, the liquid refrigerant remaining in the refrigerant circulating line may flow from the refrigerant circulating line to the compressor 204 due to the low outdoor temperature, thus resulting in an oil separation from the liquid refrigerant in the compressor 204. Therefore, the outdoor temperature at which the liquid refrigerant flows from the refrigerant circulating line to the compressor 204 during the stoppage of the compressor 204 is experimentally determined, and the determined outdoor temperature is preset to a reference outdoor temperature. After presetting the reference outdoor temperature, the compressor starts the operation through a pre-driving operation capable of sufficiently increasing an internal temperature of the compressor 204. After predriving the compressor 204, the control valve 262 which is mounted in the refrigerant circulating line connected to an inlet port of the compressor 204 is opened to allow a flow of the liquid refrigerant from the refrigerant circulating line to the compressor 204. In such a case, the internal temperature of the compressor 204 is sufficiently increased due to the pre-driving operation, and no problems occur in the compressor 204 regardless of an inflow of the refrigerant from the refrigerant circulating line to the compressor 204. The outdoor temperature is sensed by the outdoor temperature sensing unit 206.

Thus, the outdoor temperature sensing unit 206, the stop time detecting unit 210, and the motor rotation detecting unit 212 may form a refrigerant inflow detecting unit detecting the inflow of the refrigerant from the refrigerant circulating line to the compressor 204 by detecting the outdoor temperature and the stop time "ts," respectively. In response to a detection signal from the refrigerant inflow detecting unit, the control unit 208 determines that there exists a possibility of the inflow of the refrigerant from the refrigerant circulating line to the compressor 204 and controls the pre-driving of the compressor 204 upon the determination of the control unit 208 before perform the normal driving of the compressor 204.

Figure 3:
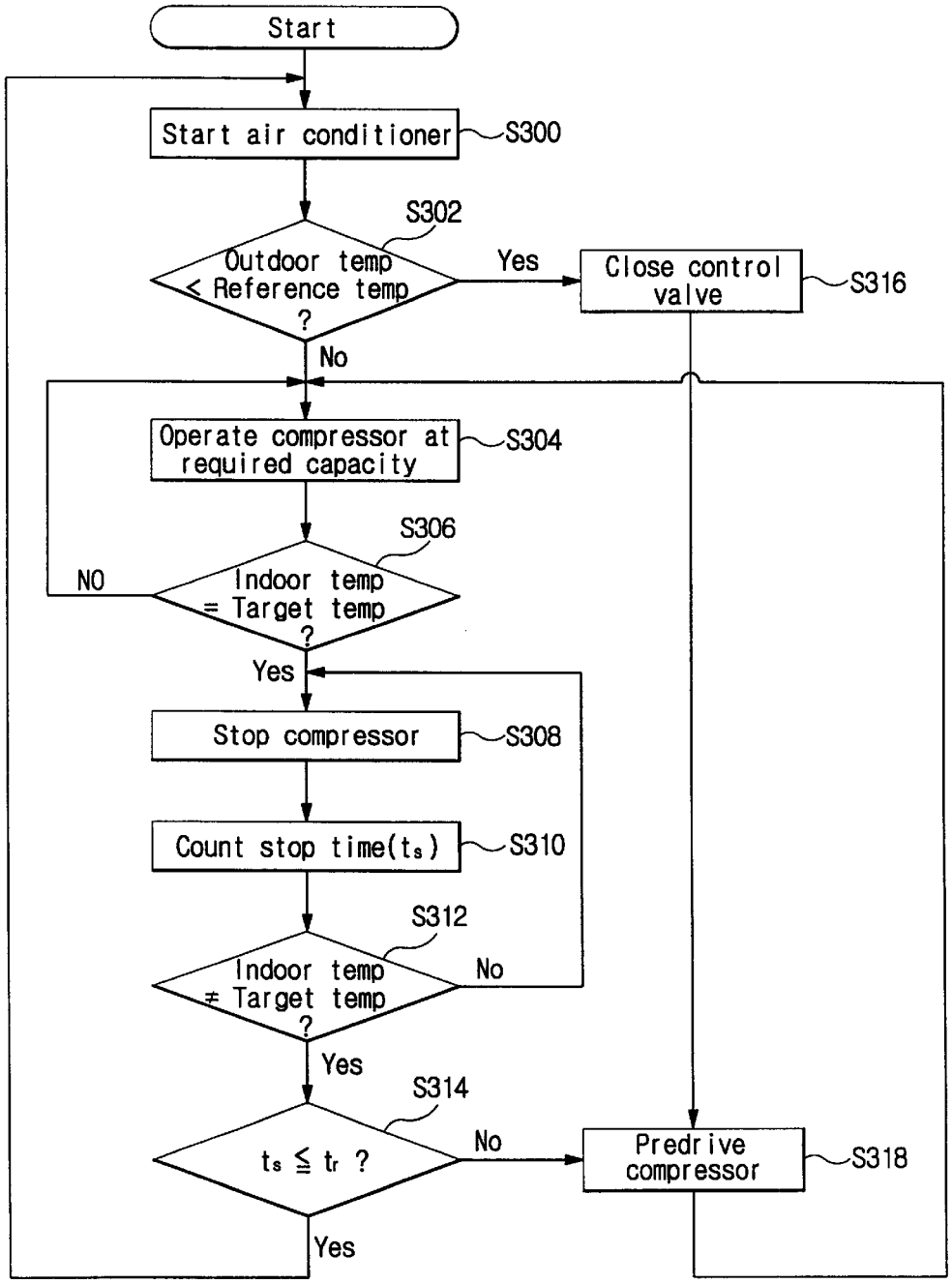
FIG. 3 is a flowchart of a method of controlling the air conditioner of FIGS. 2A and 2B.

FIG. 3 is a flowchart of a method of controlling the air conditioner according to another embodiment of the present invention. As shown in FIG. 3, when the air conditioner starts the operation in operation S300, the control unit 208 compares the sensed outdoor temperature with the reference outdoor temperature in operation S302. When the sensed outdoor temperature is not lower than the reference outdoor temperature, the compressor 204 is normally operated at the desired capacity to meet the load imposed by indoor units 254, in operation S304, thus heating or cooling the indoor air. However, when it is determined in operation S302 that the sensed outdoor temperature is lower than the reference outdoor temperature, the control unit 208 completely closes the control valve 262 in operation S316, and predrives the compressor 204 in operation S318 so as to drive the first and second compression stages 204*a* and 204*b* at the same time for a predetermined period of time prior to normally operating the compressor 204 at the desired capacity to meet the load imposed by the indoor units 254 in operation S304.

Thereafter, the control unit 208 determines whether the sensed indoor temperature is equal to the target temperature in operation S306. When it is determined that the sensed indoor temperature is equal to the target temperature, the compressor 204 is stopped in operation S308. Thereafter, In operation S310, the stop time "ts" of the compressor 204 is counted. During counting a period of the stop time "ts" in which the compression stages 204*a* and 204*b* of the compressor 204 are stopped, the indoor temperature is sensed. In operation S312, the control unit 208 compares the sensed indoor temperature with the target temperature. When it is determined in operation S312 that the sensed indoor temperature is not equal to the target temperature, the control unit 208 compares the counted stop time "ts" with the reference time "tr" in operation S314.

When it is determined in operation S314 that the counted stop time "ts" is not longer than the reference time "tr," the control unit 208 determines that the desired lubricating effect of the compressor 204 can be accomplished. Thus, the control unit 208 normally operates the compressor 204 at the desired capacity to meet the load imposed by the indoor units 254, in operation S304. However, when it is determined in operation S314 that the counted stop time "ts" is longer than the reference time "tr," the control unit 208 determines that the desired lubricating effect of the compressor 204 cannot be accomplished. Thus, the control unit 208 pre-drives the compressor 204 in operation S318 so as to drive the first and second compression stages 204*a* and 204*b* at the same time for the predetermined period of time and operates the compressor 204 normally in the desired capacity to meet the load imposed by the indoor units 254, in operation S304, thus heating or cooling the indoor air so as to make the indoor temperature equal to the target temperature.

In accordance with an aspect of the present invention, the stop time detecting unit 210 may acquire first information of the stoppage start time from an initially inactivated motor drive signal outputted from the control unit 208, and second information of the stoppage end time from a signal outputted from the indoor temperature sensing unit 214. It is determined that if the sensed indoor temperature is not equal to the target temperature, it is needed to operate the compressor 204. The stop time detecting unit 210 thus calculates the stop time "ts" of the compressor 204 from the first and second information.

In FIGS. 2A and 2B, the control unit 208 detects a rotating state of the motor 204C so as to acquire the first information of the stoppage start time of the compressor 204. According to another aspect of the present invention, it is possible to precisely detect the stoppage start time of the compressor 204 through the motor rotation detecting unit 212 and the stop time detecting unit 210. However, an additional detecting unit, that is, the motor rotation detecting unit 212, may not be necessary. The motor rotation detecting unit 212 may be not required to detect the rotating state of the motor 204C, thus further simplifying a construction of the air conditioner, even though there may be a small gap between a real time when the motor 204C is stopped and a driving time when the motor drive signal outputted from the control unit 208 becomes inactivated.

As described above, the present invention provides an air conditioner with a variable capacity compressor and a method of controlling the air conditioner. The variable capacity compressor of the air conditioner is operated at a maximum capacity in a case of starting an operation of the variable capacity compressor after an extended stoppage for a lengthy period of time longer than a preset reference time, thus increasing an amount of circulated refrigerant during an initial stage of the operation and increasing a quantity of heat generated from the motor of the compressor to vaporize and forcibly discharge the remaining liquid refrigerant from the compressor during the initial stage. Therefore, the variable capacity compressor of this air conditioner does not require heaters, and so it is easy to design and produce such a compressor, in addition to a reduction in the production cost of the air conditioner. Another advantage of this air conditioner resides in that it is possible to reduce a maintenance cost of the air conditioner.

Although a few preferred embodiments of the present invention have been described for illustrative purposes, it would be appreciated by those skilled in the art changes, various modifications, additions and substitutions may be made in the embodiment without departing from the principles and sprit of the invention, the scope of which is defined in the accompanying claims and their equivalents.

What is claimed is:

1. An air conditioner with a variable capacity compressor, comprising:

a signal receiving unit receiving a capacity value of the compressor corresponding to a load imposed on the compressor;

a liquid refrigerant inflow detecting unit detecting an inflow of a liquid refrigerant to the compressor; and a control unit controlling the compressor such that the control unit pre-drives the compressor when the refrigerant inflow detecting unit detects the inflow of the liquid refrigerant to the compressor, and then normal-drives the compressor at a required capacity corresponding to the capacity value to meet the load imposed on the compressor after receiving the capacity value of the compressor through the signal receiving unit.

2. The air conditioner according to claim 1, wherein the liquid refrigerant inflow detecting unit comprises a stop time detecting unit which detects a period of a stop time from a stoppage start time when the compressor stops, to a stoppage end time when the compressor starts an operation.

3. The air conditioner according to claim 2, wherein the control unit determines that there is the inflow of the liquid refrigerant to the compressor when the stop time of the compressor is longer than a preset reference time.

4. The air conditioner according to claim 2, wherein the control unit pre-drives the compressor for a pre-driving time which is preset in proportion to the stop time of the compressor.

5. The air conditioner according to claim 1, wherein the liquid refrigerant inflow detecting unit comprises an outdoor temperature detecting unit which detects an outdoor temperature around an area where the compressor is installed.

6. The air conditioner according to claim 5, wherein said control unit determines that there is the inflow of the liquid refrigerant to the compressor when the outdoor temperature is lower than a preset reference temperature.

7. The air conditioner according to claim 5, wherein the control unit pre-drives the compressor for a compressor predriving time which is preset to be in inverse proportion to the outdoor temperature.

8. The air conditioner according to claim 5, wherein the air conditioner comprises a refrigerant circulating line coupled to an inlet port of the compressor, and the control unit comprises:

a control valve mounted on the refrigerant circulating line, wherein when the outdoor temperature is lower than a preset reference temperature, the control valve is closed to prevent the inflow of refrigerant to the compressor, and the compressor is pre-driven.

9. An air conditioner with a variable capacity compressor, comprising:

a stop time detecting unit detecting a stop time of the compressor; and a control unit controlling the compressor such that when the stop time of the compressor is longer than a preset reference time, the control unit pre-drives the compressor prior to normal-operating of the compressor in response to a required capacity to meet a load imposed on the compressor.

10. The air conditioner according to claim 9, wherein the control unit pre-drives the compressor for a compressor predriving time which is preset to be in proportion to the stop time of the compressor.

11. An air conditioner with a variable capacity compressor and a refrigerant circulating line coupled to an inlet port of the compressor, comprising:

a control valve mounted on the refrigerant circulating line;

an outdoor temperature detecting unit detecting an outdoor temperature; and a control unit controlling the air conditioner such that when the outdoor temperature detected by the outdoor temperature detecting unit in an initial starting state of the compressor is lower than a preset reference temperature, the control unit closes the control valve so as to prevent an inflow of a refrigerant to the compressor through the refrigerant circulating line and pre-drives the compressor.

12. The air conditioner according to claim 11, wherein the control unit pre-drives the compressor for a compressor pre-driving time which is preset to be in inverse proportion to the outdoor temperature.

13. A method of controlling an air conditioner with a variable capacity compressor, the method comprising:

detecting an inflow of a liquid refrigerant to the compressor;

pre-driving the compressor when there is the inflow of the liquid refrigerant to the compressor; and operating the compressor in a required capacity in accordance with a capacity value of the compressor to meet a load imposed on the compressor.

14. The method according to claim 13, wherein the detecting of the refrigerant inflow comprises:

detecting a period of a stop time from a stoppage start time when the compressor is stopped to a stoppage end time when the compressor is started again.

15. The method according to claim 14, wherein the detecting of the refrigerant inflow comprises:

determining that there is the inflow of the liquid refrigerant to the compressor when the stop time of the compressor is longer than a preset reference time.

16. The method according to claim 14, wherein the pre-driving of the compressor comprises:

presetting a compressor pre-driving time to be in proportion to the stop time of the compressor.

17. The method according to claim 13, wherein the detecting of the refrigerant inflow comprises:

detecting an outdoor temperature around an area where the compressor is installed.

18. The method according to claim 17, wherein the detecting of the refrigerant inflow possibility comprises:

determining that there is the inflow of the liquid refrigerant to the compressor when the outdoor temperature is lower than a preset reference temperature.

19. The method according to claim 17, wherein the pre-driving of the compressor comprises:

presetting a compressor pre-driving time to be in inverse proportion to the outdoor temperature.

20. The method according to claim 17, wherein when the outdoor temperature is lower than a preset reference temperature, the compressor is pre-driven under a condition that the inflow of the refrigerant to the compressor is prevented.

21. A method of controlling an air conditioner with a variable capacity compressor, the method comprising:

detecting a stop time of the compressor;

comparing the stop time of the compressor with a preset reference time, and pre-driving the compressor when the stop time is longer than the preset reference time; and operating the compressor in a required capacity to meet a load imposed on the compressor after completing the pre-driving of the compressor.

22. The method according to claim 21, wherein the comparing of the stop time comprises:

presetting a compressor predriving time to be in proportion to the stop time of the compressor.

23. A method of controlling an air conditioner with a variable capacity compressor and a refrigerant circulating line coupled to an inlet port of the compressor, the method comprising:

detecting an outdoor temperature around an area where the compressor is installed, and controlling the refrigerant circulating line to prevent an inflow of a refrigerant to the compressor from the refrigerant circulating line when the outdoor temperature is lower than a preset reference temperature;

pre-driving the compressor when the inflow of the refrigerant to the compressor is prevented; and allowing the inflow of the refrigerant to the compressor after completing the pre-driving of the compressor, and operating the compressor in a required capacity to meet a load imposed on the compressor.

24. The method according to claim 23, wherein the pre-driving the compressor comprises:

presetting a compressor predriving time to be in inverse proportion to the outdoor temperature.

* * * * *